US006354830B1

(12) United States Patent
de Nanclares

(10) Patent No.: US 6,354,830 B1
(45) Date of Patent: Mar. 12, 2002

(54) CONTROL CIRCUIT FOR GAS BURNERS

(75) Inventor: Eduardo Beltran de Nanclares, Aretxabaleta (ES)

(73) Assignee: Fagor, S. Coop., Mondragon (ES)

( * ) Notice: Subject to any disclaimer, the term of this patent is extended or adjusted under 35 U.S.C. 154(b) by 43 days.

(21) Appl. No.: 09/621,414

(22) Filed: Jul. 21, 2000

(30) Foreign Application Priority Data

Jul. 23, 1999 (ES) ..... 9901670

(51) Int. Cl.[7] ..... F24C 3/12; F23N 5/00; F23Q 9/08; F23Q 23/00

(52) U.S. Cl. ..... 431/80; 431/18; 431/78; 431/75

(58) Field of Search ..... 431/280, 281, 431/278, 18, 75, 77, 78, 80

(56) References Cited

U.S. PATENT DOCUMENTS 4,082,493 A * 4/1978 Dahlgren
4,101,258 A * 7/1978 Jacobsz
5,169,303 A * 12/1992 Paluck
5,282,739 A * 2/1994 Chinsky et al.
5,722,823 A * 3/1998 Hodgkiss
5,749,718 A * 5/1998 Berlincourt
5,875,773 A * 3/1999 Jansen
6,126,435 A * 10/2000 Fredin-Garcia et al.
6,164,958 A * 12/2000 Huang et al. ..... 126/39 BA

FOREIGN PATENT DOCUMENTS

| | | | | |
|---|---|---|---|---|
| FR | 2758179 | * | 7/1998 | ..... 431/78 |
| GB | 2249382 | * | 5/1992 | ..... 431/80 |
| JP | 09-112912 | * | 5/1997 | ..... 431/80 |

* cited by examiner

*Primary Examiner*—Carl D. Price
(74) *Attorney, Agent, or Firm*—The Kline Law Firm

(57) ABSTRACT

A first object of the invention is to provide a control circuit (1) for gas burners with a fail-safe system. The circuit (1) includes a microcontroller (2) that acts on at least one valve (4), flame detector circuits (50) and tap opening detector switches (6). For each valve (4) the circuit (1) has a plurality of switches by means of which these valves are supplied with the voltage required to open them and keep them open. The microcontroller (2) governs said switches in accordance with the signals it receives from the circuits (5), from the switches (6), and from points of the actual circuit (1). The circuit (1) is safe against the failure of any of its components, including the microcontroller (2).

A second object of the invention is also to provide a circuit (1) that has protection against a double failure.

16 Claims, 10 Drawing Sheets

CONTROL CIRCUIT FOR GAS BURNERS

TECHNICAL FIELD

The present invention relates to combustion control systems and more specifically to combustion control systems for gas burners, in particular for cooker hobs.

PRIOR ART

GB2249382 A describes a gas burner ignition system with a safety device. This safety device includes a safety valve that keeps the flow of gas to the burner open when the thermocouple at this burner detects that there is a flame. The axial movement of the tap opening control is needed to open the safety valve. When this valve is open, a voltage that keeps the valve open while the thermocouple warms up is applied to it by means of a pulse generator. Then, it is the actual thermocouple that supplies the safety valve directly with the voltage needed for it to be kept open.

JP09112912 A shows a circuit that monitors the voltage of the thermistor located at the cooker burner and closes the solenoid valve for the flow of gas when the tap opening detector switch is at ON and the value of the thermistor voltage is below a given level.

DISCLOSURE OF THE INVENTION

An initial object of the invention is to provide a control circuit for gas burners, in particular for cooker hobs, with a fail-safe system, as defined in the claims. Said control circuit includes a microcontroller that activates the burner spark generator circuit and acts on the gas flow valves associated with the burners in accordance with the signals it receives from the flame detector circuits of these burners and from the tap opening detector switches associated with each burner. In addition, the microcontroller also monitors the flow of current at least at one of the points of the control circuit, so as to close the respective valve in the event of detecting any anomaly.

The circuit of the invention is specially designed for use with low voltage DC valves, especially if said valves are adapted to operate referenced to ground.

In general, flame detector circuits include a thermocouple. In the circuit of the invention said thermocouples do not act directly on the valves, but rather it will be the microcontroller that acts on them in accordance with, amongst other signals, the signal obtained from said thermocouples.

The gas flow tap associated with each burner consists of a rotary control operated by the user and of a valve that is actuated directly by the control circuit. An axial movement does not have to be applied as well to the rotary control as on traditional systems. On being turned, the status of said switch being read by the microcontroller of the control circuit.

For flow to take place to a burner, two conditions have to be met: the user should open the tap corresponding to said burner and the electronic circuit should open the valve of said burner. This makes it possible to use a single valve for all the burners.

An operating voltage is applied to the valves to open them and, once they are open, a maintenance voltage is applied to them. Said maintenance voltage is lower than the operating voltage but sufficient to keep the valves open. In this way, a more economic and more compact design is obtained (the volume of the power supply is reduced). The valve described in the Spanish Patent Application with Application No. P9900547 is an example of a valve that may be acted upon using one voltage to open it and another to keep it open. On said valve, the energy required to attract its armature is greater than the energy needed to keep it attracted.

For each valve, the control circuit of the invention includes a switch which, when closed, supplies the operating voltage to said valves, a switch which, when closed, supplies the maintenance voltage to said valves, and a switch which, when closed, short-circuits said valves, so that they are de-energized.

In this way, both the operating voltage and the maintenance voltage of each valve are supplied by means of the closing of a switch and the opening of a second switch. This means that the system is safe against the failure of any of said switches. Thus, even if one of the switches fails, there is another switch on which the microcontroller will act in the event of such a failure, so that no voltage is supplied to the valve and all possibility of gas leakage is thereby prevented. Furthermore, in the event of the failure of a switch, the system is safe against the failure (short circuit, open circuit, etc.) of any components of the control circuit other than these.

In the preferred embodiment of the invention, one terminal of the valves is connected to the chassis where the burners are generally located, whereby the return of the operating and maintenance currents is carried out by way of said chassis. Said chassis is usually connected to earth.

In general, one terminal of the flame sensors (usually thermocouples) and one terminal of the tap switches are also connected to said chassis. Connecting one terminal of the valves, the flame sensors and the tap switches to the chassis offers advantages in terms of economy and reliability, since:

- As the insulation of the valves and the flame sensors in respect of the supply system is provided by means of the supplier transformer, the construction of said valves and said flame sensors is simplified.
- The signals from the valves, flame sensors and tap switches are being returned through the chassis, so the number of wires and connecting components is cut by half.

So that failures in the control circuit may be detected, the microcontroller checks the current flow at least at one point of said control circuit. In view of the arrangement in the circuit of the operating switch, the maintenance switch and the switch that short-circuits each valve, by checking the current flow through each valve the microcontroller can determine the state of the three switches corresponding to said valve.

To ensure that said valves are closed also in case it is the actual microcontroller that fails, at least one circuit is added that acts on one or more switches depending on whether said circuit receives pulses or not from the microcontroller, the closing of the respective valves being brought about when said circuits cease to receive pulses. The switches that short out the valves have a circuit of these characteristics, whereby the valves remain short-circuited in the event of failure of the microcontroller.

The use of a microcontroller successfully endows the control circuit with a flexibility that enables functions to be added to said control circuit. Thus, for instance, the following additional features will be added: reignition attempt during a given period of time if the flame accidentally goes out, indication of the state of the burners and the cooker hob by display, keys for locking and releasing the hob, etc.

A second object of the invention is also to provide a dual fail-safe control circuit, as defined in the claims. Thus, providing the circuit with a few additional items succeeds in making the circuit of the invention safe against any failure of the system components, but also against two failures of these components, even if they occur simultaneously.

DETAILED DISCLOSURE OF THE INVENTION

Figure 1:
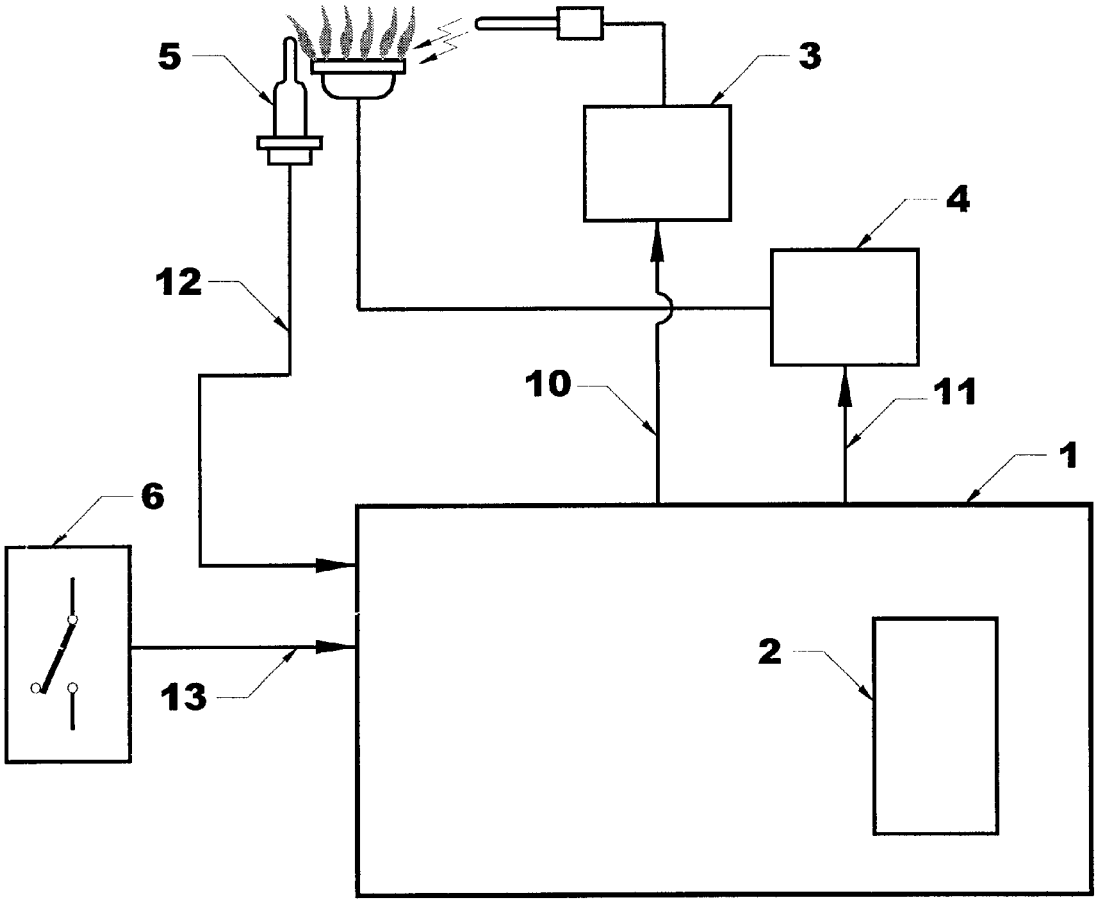
FIG. 1 represents a general diagram of the control circuit for gas burners together with the devices with which it interacts.

FIG. 1 shows the control circuit 1 that is the object of the invention, together with a thermocouple 5, a switch 6, a spark generator 3 and a valve 4 with which it interacts, which receives the signals 12 and 13 from the thermocouple 5 and the switch 6 respectively and sends the signals 10 and 11 to the spark generator circuit 3 and the valve 4 respectively. In the preferred embodiment there Is a thermocouple 5, a switch 6 and a valve 4 for each burner, although the possibility of using a single valve 4 for all the burners is also contemplated.

In this preferred embodiment, one terminal of the valves 4, the thermocouples 5 and the switches 6 is connected to the chassis, whereby the operating and maintenance currents, the voltage reading signal of the valves 4 and the signal supplied by the thermocouples 5 and the tap switches 6 will return via said chassis.

Both FIG. 1 and the following ones show only the circuit corresponding to one valve 4. For the more usual case in which the microcontroller 2 monitors a set of burners, the control circuit 1 is repeated for each one of these valves 4 (although there may be components common to all the valves 4.

Figure 2:
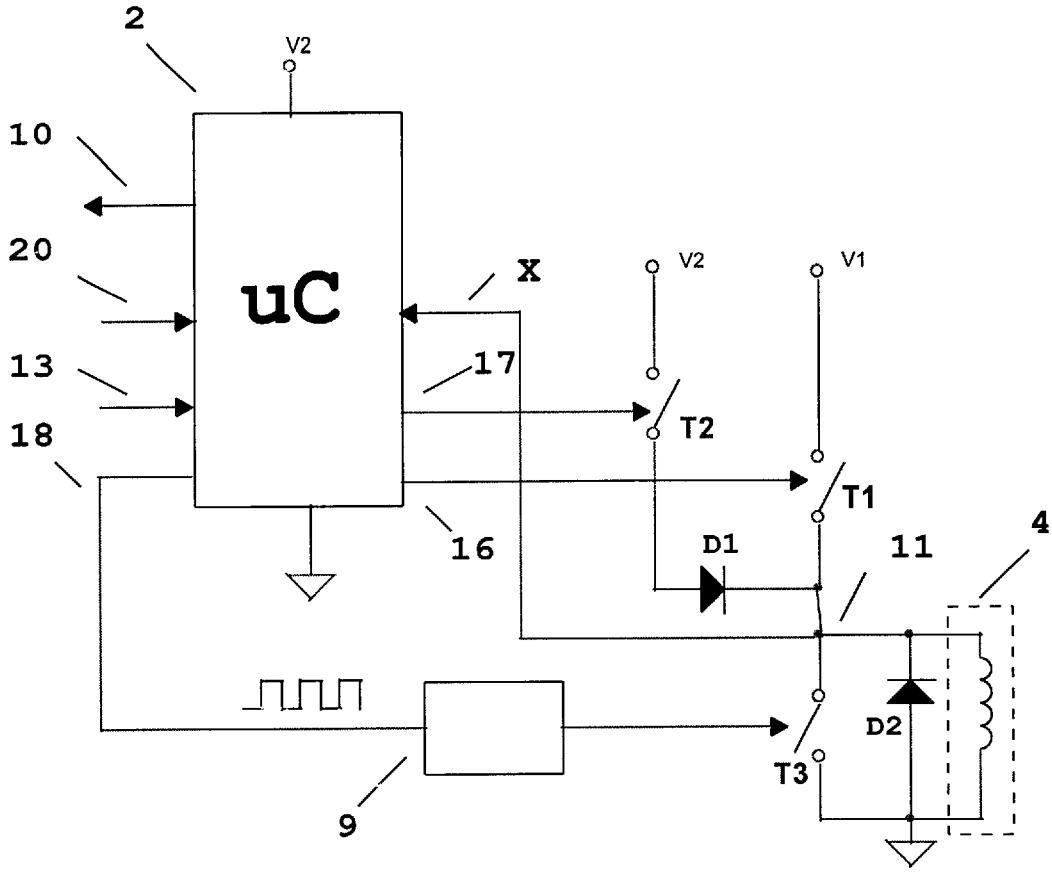
FIG. 2 represents a diagram of the basic layout of the control circuit according to the invention for each valve on which said control circuit acts.

FIG. 2, which represents the control circuit 1, shows the microcontroller 2, which, besides signals 20 and 13, receives signal X from the actual control circuit 1. Besides sending a signal 10 to the spark generator circuit 3 of each burner, the microcontroller 2 sends signals 16 and 17 to the switches T1 and T2 of each valve 4 and sends signal 18 to circuit 9, which in turn acts on switch T3 of each valve 4.

Both the operating voltage V1 and the maintenance voltage V2 are obtained from the supply transformer, which provides the necessary insulation between the supply network and the control circuit 1.

Diode D1 prevents the flow of current from the arm of T1 to the arm of T2, as V1 is greater than V2. Diode D2 is also added between the input terminals of valve 4 to de-energize the magnetic unit of this valve 4 at the times when it opens.

The microcontroller 2 obtains the status of switches T1, T2 and T3 with signal X, by means of which the flow of current through valve 4 is monitored. If the microcontroller 2 detects that any one of the switches (T1, T2 or T3) is open when it should be closed or vice versa it acts accordingly, closing valve 4, for instance, to prevent situations of risk.

Figure 3:
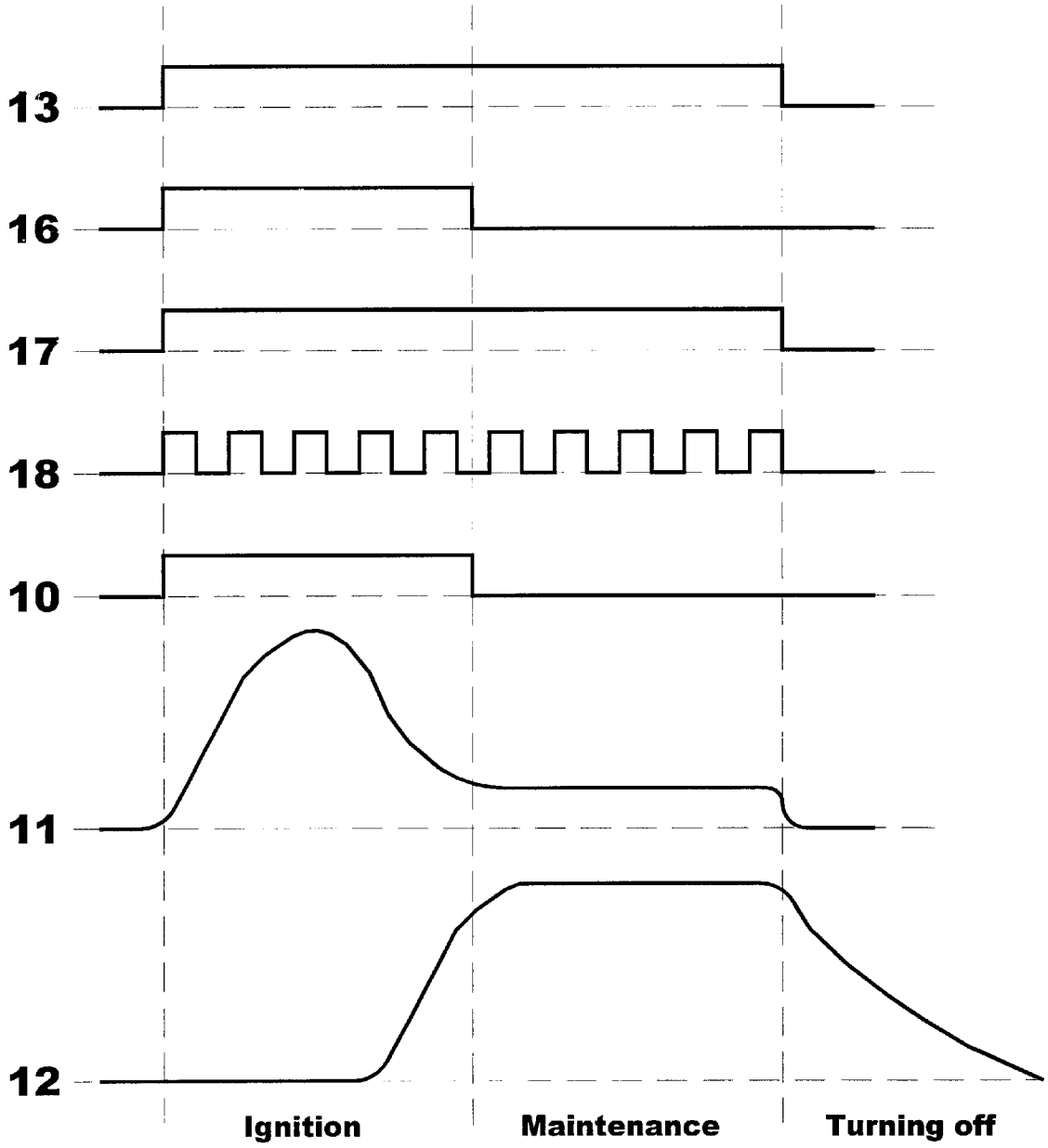
FIG. 3 represents the main signals involved in the control circuit of FIG. 2.

FIG. 3 shows the main signals that are involved in the sequence of igniting the burner, keeping it on and turning it off. When the user operates the tap opening control, switch 6 adopts the ON position as shown in signal 13 represented in this FIG. 3. At that moment, the microcontroller 2 closes switches T1 and T2 and opens switch T3 with signals 16, 17 and 18, respectively. After an initial period in which the operating voltage V1 is supplied to the valve 4, the status of signal 16 is modified and switch T1 closes. After that only the maintenance voltage V2 is supplied.

FIG. 3 shows the signal 11, received by valve 4, as well as signal 12 received by the flame detector circuit 50 from the thermocouple 5. The microcontroller 2 causes the spark generator circuit 3 to generate a spark during the ignition sequence by way of signal 10.

When the user turns the burner off by operating the tap opening control, switch 6 moves to the OFF position and immediately changes the status of signals 17 and 18, so that T2 opens and T3 closes.

Figure 4:
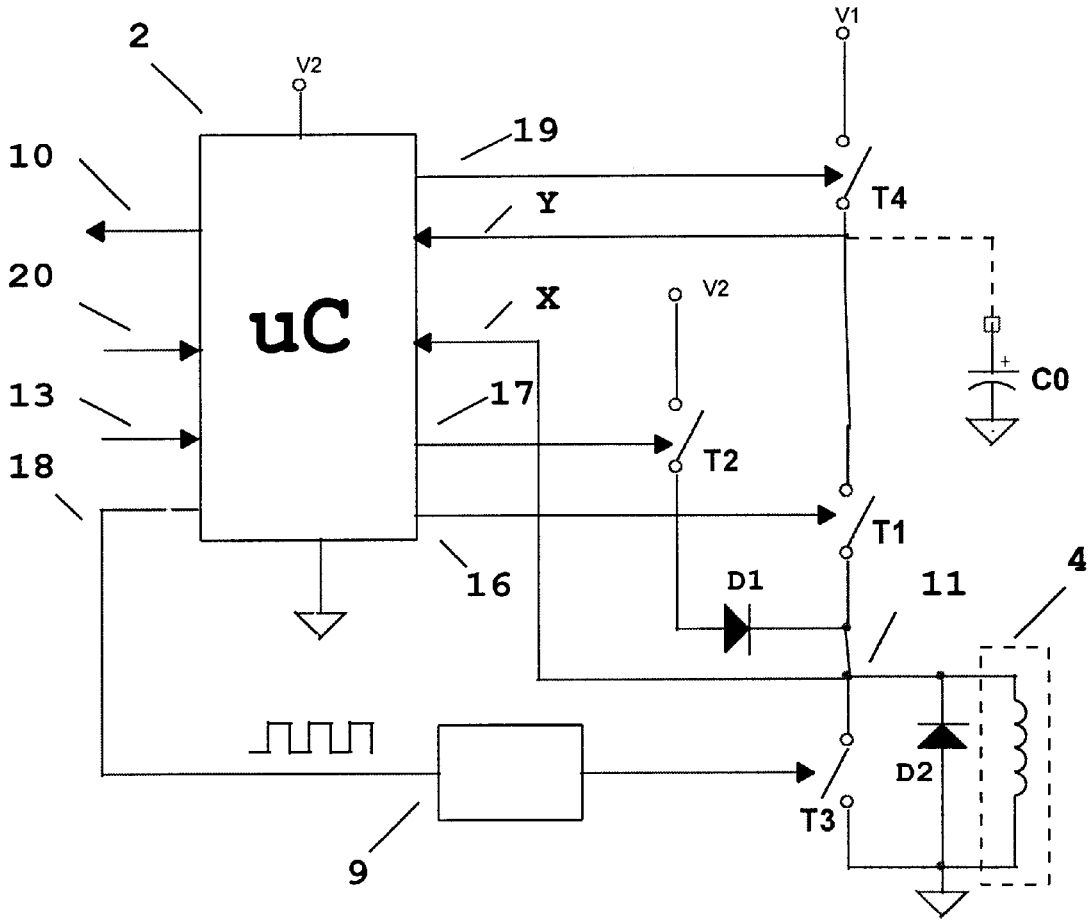
FIG. 4 shows a diagram of the layout of the circuit of the preferred embodiment of the invention.

FIG. 4 shows the diagram of a preferred embodiment. In this embodiment, a transistor T4 is added in series with the switches T1 of each valve 4. A capacitor CO connected to ground is included between said switches T4 and T1, T4 and CO being common to all the valves 4. The power of the supply is reduced with this configuration as the operating energy for the valves 4 is no longer taken directly from said supply but comes from the charge stored in the capacitor CO for a given period of time.

Switch T4 is a low current transistor, as only the capacitor charge current circulates through it, or in abnormal working conditions, the power supply short-circuit current, which is of a very low value, as its power is reduced. The switches T1 are executed with thyristors, which may be governed very simply from the microcontroller 2, and they confer great strength on the circuit very economically. Switch T4 also facilitates the switching off of said thyristors T1.

In this case, by means of reception of a signal Y by the microcontroller 2, said microcontroller 2 is able to ascertain the status of the switches T4 and T1 immediately by means of the signals X and Y.

Figure 5:
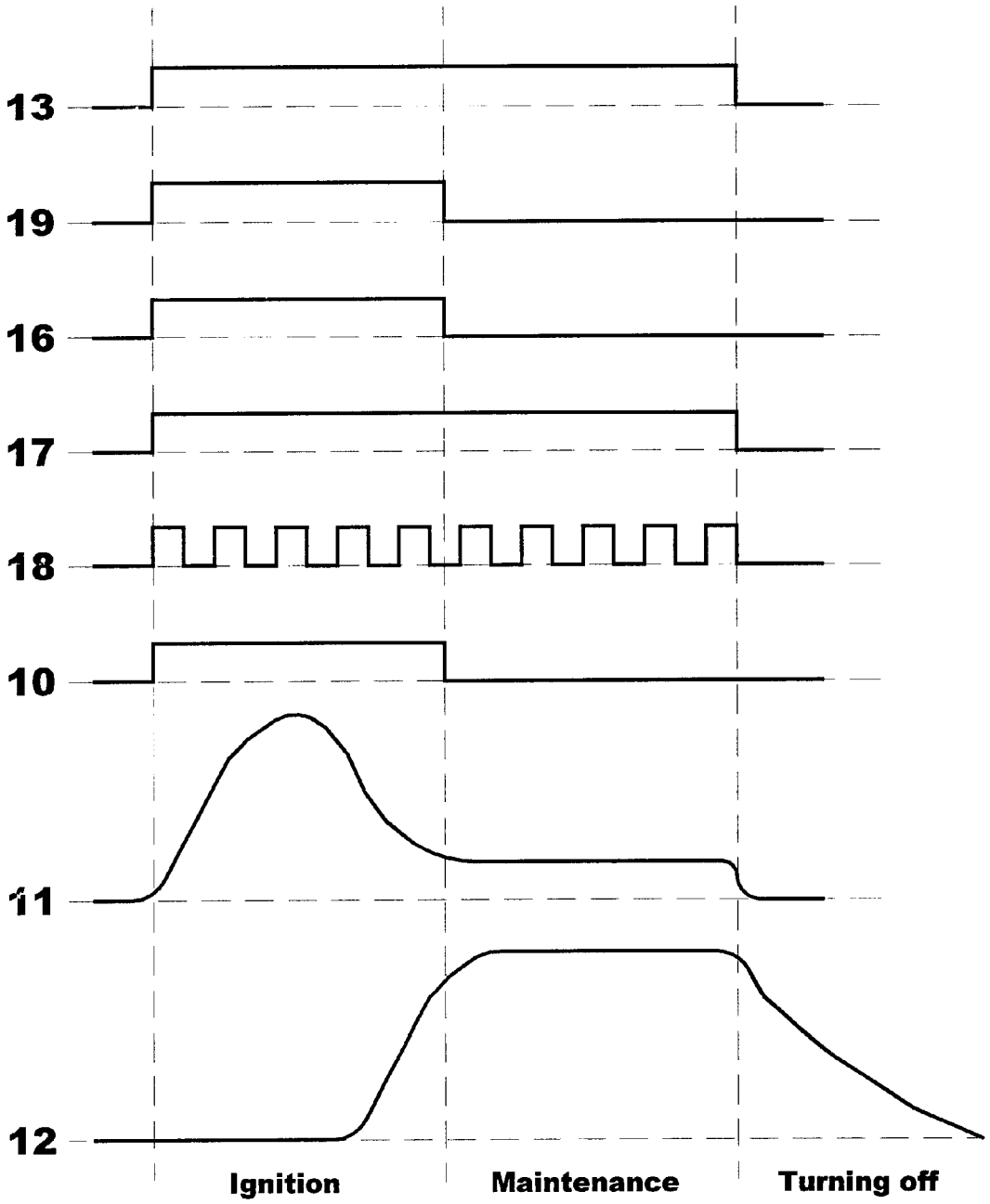
FIG. 5 represents the main signals involved in the control circuit of FIG. 4.

FIG. 5 shows the main signals that are involved in this embodiment. Said signals include, in addition to the previously described signals, the signal 19 that the microcontroller 2 sends to the switch T4.

Figure 6:
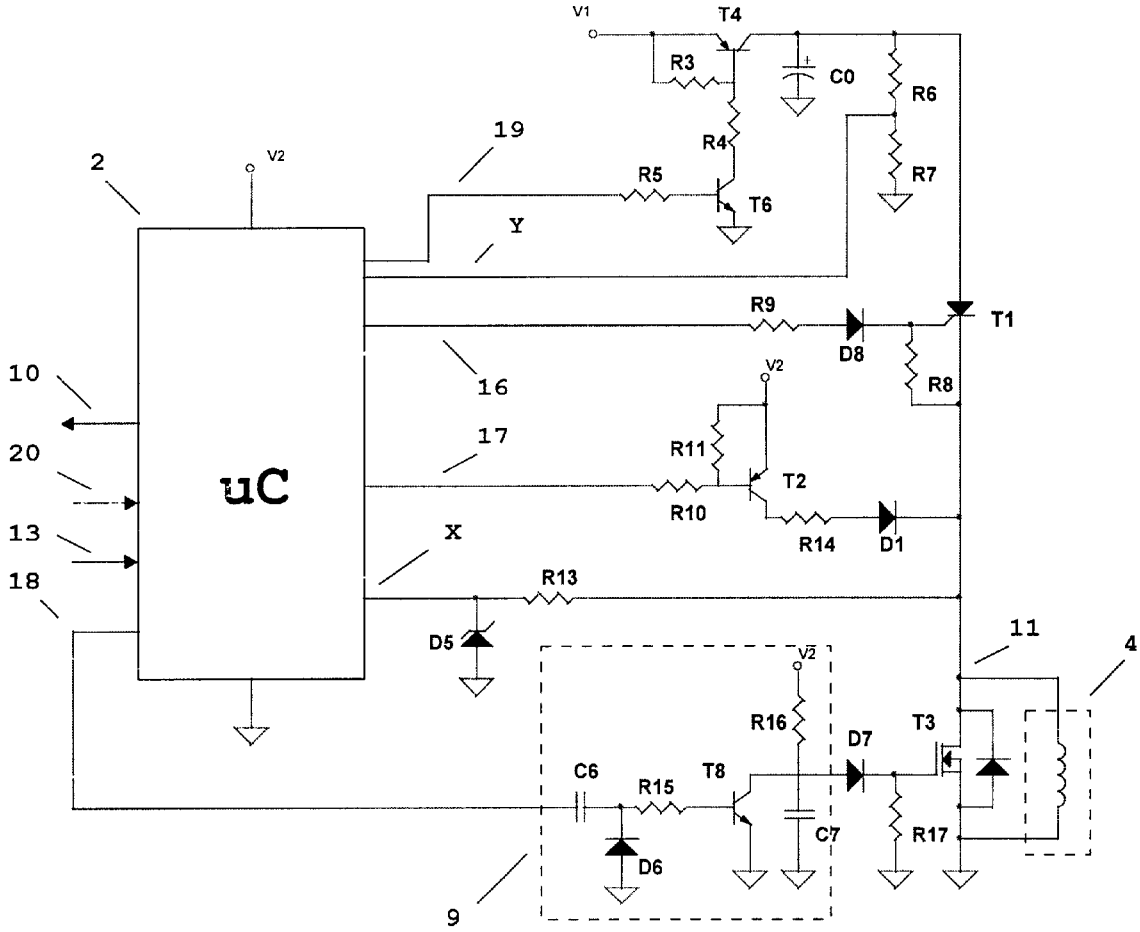
FIG. 6 shows a detail view of the preferred embodiment of the control circuit of the invention.

FIG. 6 shows a detail view of the control circuit 1 in its preferred embodiment. Circuit 9, which receives pulses from the microcontroller 2, is a monostable circuit and consists of components C6, D6, R15, T8, R16 and C7. The switch T2 is a PNP transistor and the switch T3 is N-channel MOSFET transistor. The signals X and Y are taken by means of R6, R7, D5 and R13. Each of said signals is read by the microcontroller 2 by means of an analogue input.

Figure 7:
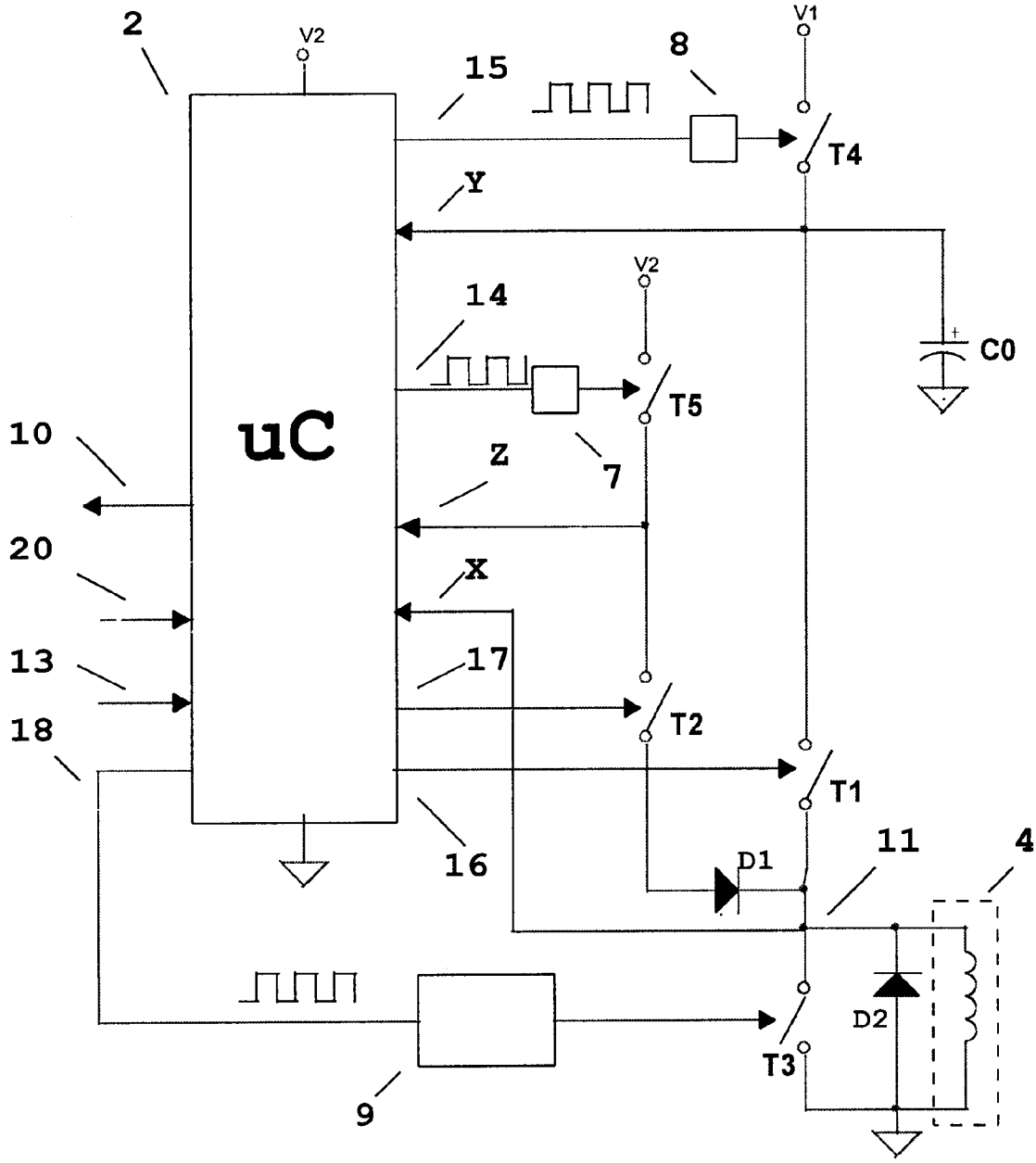
FIG. 7 shows a diagram of the layout of the circuit of the invention with double failure protection.

The inclusion of a few additional components provides the control circuit 1 with double failure protection. FIG. 7 shows the diagram of the circuit 1 including these additional items to obtain a control circuit 1 offering protection against any double failure, be it of the switch units or any other components of the control circuit 1 (including the microcontroller 2). To achieve this circuit, the above-described circuit is provided with the following additional items:

A switch T5 common to all the valves 4 arranged in series with the switches T2 of each valve 4.

A monostable circuit 8, governed by a pulse signal 15 which reaches it from the microcontroller 2, and which controls the opening and closing of the switch T4

A monostable circuit 7, governed by a pulse signal 14 which reaches it from the microcontroller 2, and which controls the opening and closing of switch T5.

By means of reception by the microcontroller 2 of a signal Z with which the current flow is monitored between switches T5 and T2, the microcontroller 2 may find out, by way of signals X, Y and Z, which of the circuit switches has failed, whereby, in the face of anomalous situations, the control circuit 1 can actuate in a different way depending on which switch has failed.

Figure 8:
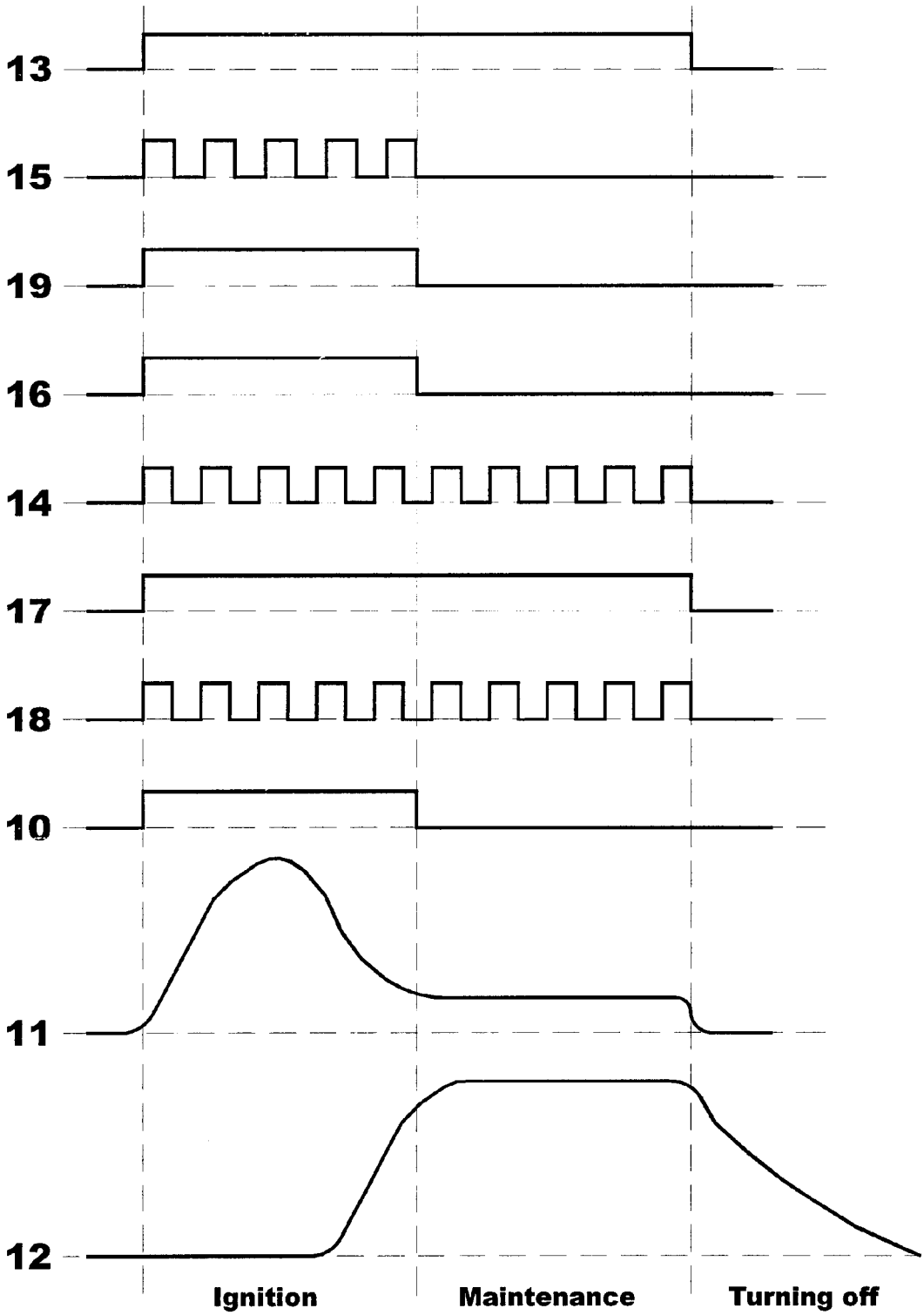
FIG. 8 represents the main signals involved in the control circuit of FIG. 7.

FIG. 8 shows the main signals that are involved in the double fail-safe circuit, including the pulse signals 14 and 15 received by the monostable circuits 7 and 8, respectively.

Figure 9:
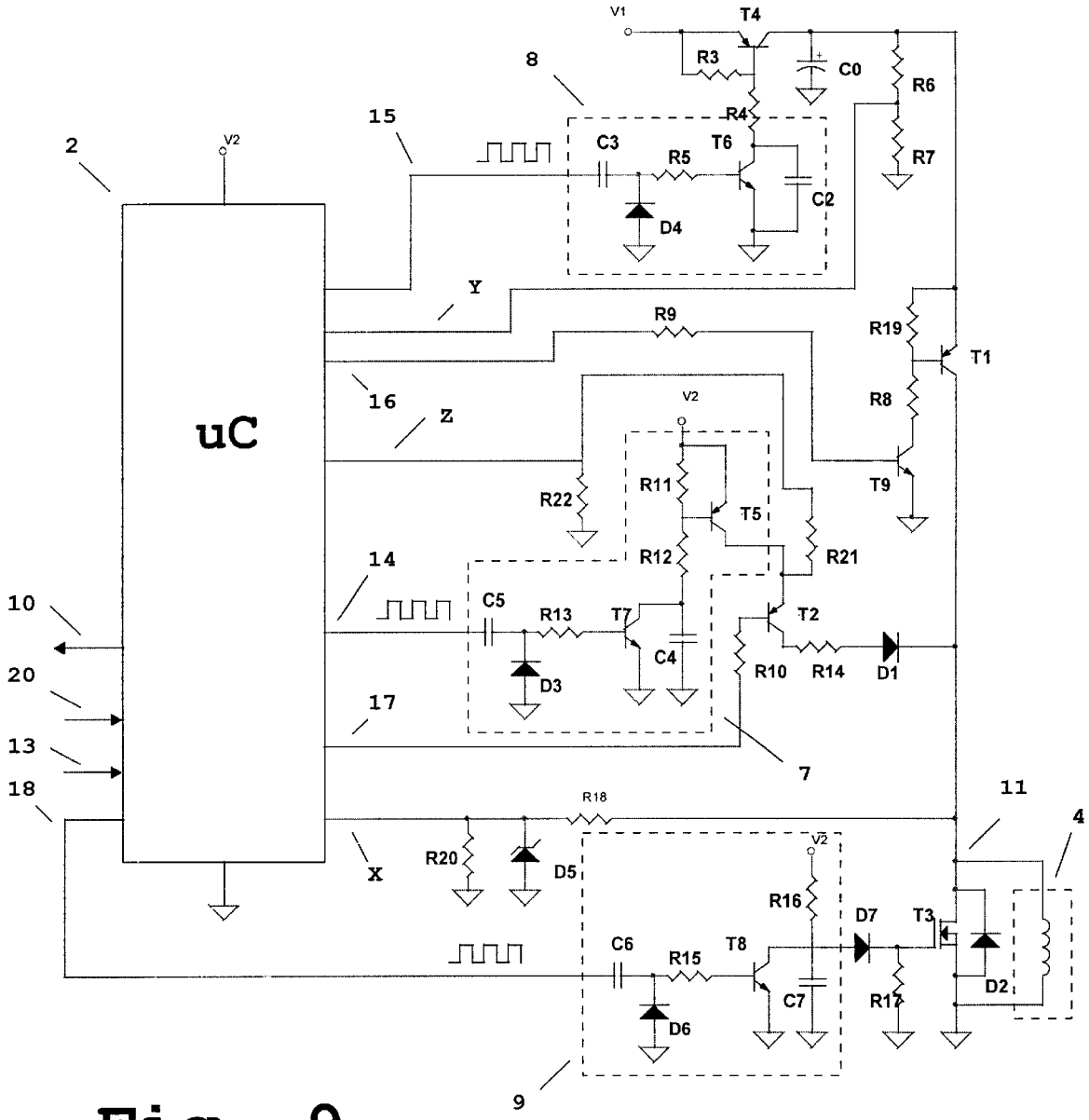
FIG. 9 shows the preferred embodiment of the control circuit of the invention with double failure protection.

FIG. 9 shows a detail view of circuit 1 with protection against double failure in its preferred embodiment. Switch T5 is a PNP transistor and monostable circuits 7 and 8 are circuits analogous to the monostable circuit 9.

In the preferred embodiment, every flame detector circuit 50 includes a thermocouple 5 connected to the microcontroller 2 by way of an inverter amplifier that has an operational amplifier 100, a signal S being supplied from the microcontroller 2 to the input of said operational amplifier 100 to check the proper working of said inverter amplifier.

Figure 10:
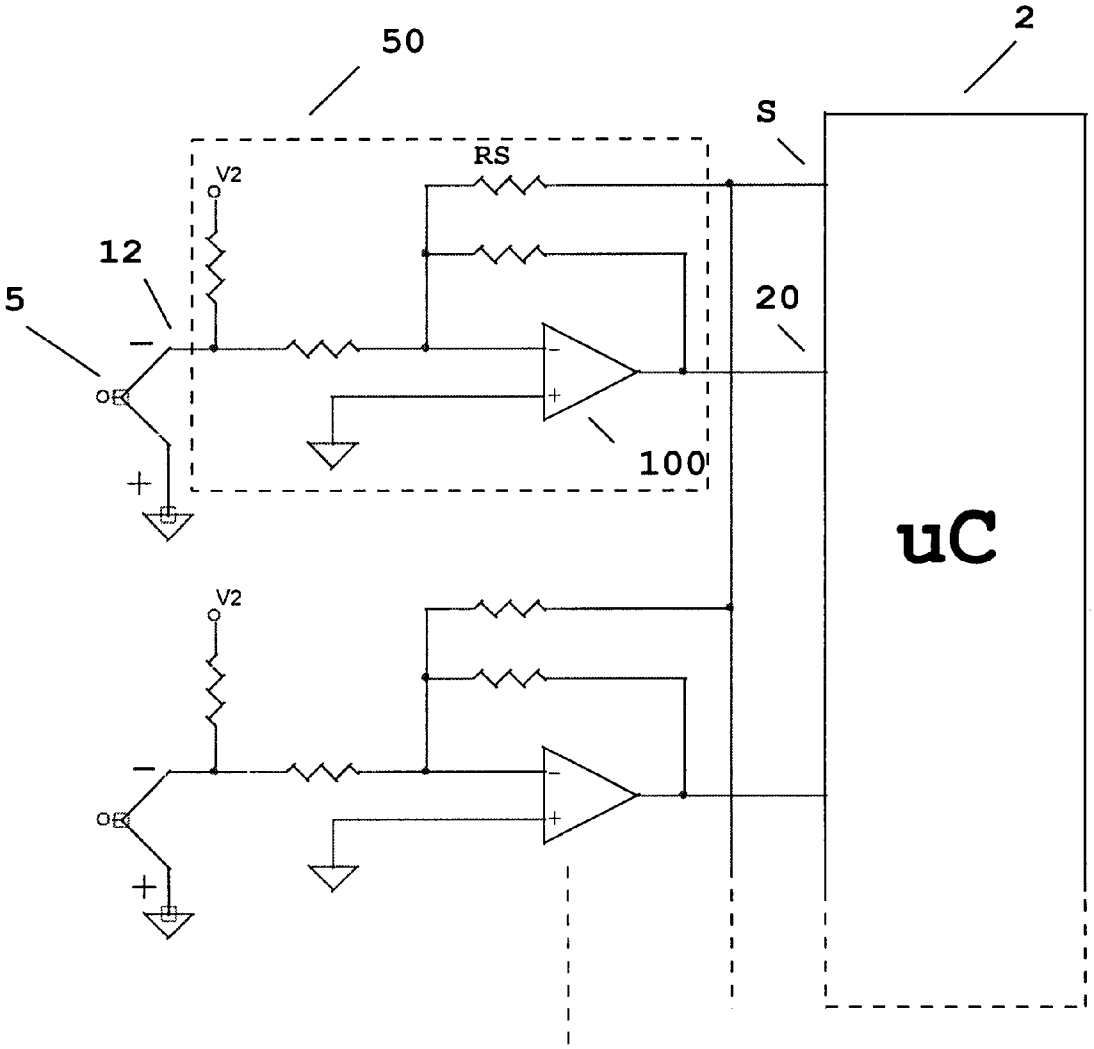
FIG. 10 represents the preferred embodiment of the control circuit flame detector circuit of the invention.

FIG. 10 shows a detail view of the preferred embodiment of this circuit 50. Circuit 50 is repeated for each burner, although signal S is common to all of them.

The classic inverter amplifier with operational circuit embodiment is provided with the additional feature of a resistor Rs , which inserts a signal S controlled by the microcontroller 2 into said inverter amplifier. The purpose of said signal S is to enable the microcontroller 2 to check the proper working of the amplifier, as the malfunctioning of this may be interpreted as the presence of flame when there is actually no flame.

Thus, the microcontroller 2 checks for each burner that by applying a high level to the signal S the output voltage 20 of the amplifier 100 drops. If the drop in signal 20 does not exceed a minimum preset value during stable flame presence, the working of amplifier 100 is not correct and the microcontroller 2 will close the valve 4 of the respective burner.

If a maximum level close to zero is obtained whenever signal S is applied, it is detected that amplifier 100 is working on open loop, so flame presence cannot be detected properly, and the microcontroller 2 closes the respective valve 4.

I claim:

1. A control circuit for gas burners comprising:

a microcontroller that operates at least one valve that opens and closes to control gas flow to said burners, a flame detector circuit for each burner, said microcontroller receiving a signal from each of said flame detector circuits, and a tap opening detector switch associated with each burner, said microcontroller receiving a signal from each of said switches; wherein each valve of said control circuit comprises an operating switch conducts an operating voltage to said valve to open said valve when said operating switch is closed;

a maintenance switch which conducts a maintenance voltage to said valve to keep said valve open when said maintenance switch is closed, and a third switch which short-circuits and de-energizes said valve when said third switch is closed; and wherein one terminal of said valve being preferably connected to a chassis housing said burners, said operating switch, said maintenance switch, and said third switch being controlled by said microcontroller, said microcontroller being connected to said third switch through a tertiary control circuit that closes said third switch if said tertiary control circuit does not receive pulses from said microcontroller, and said microcontroller actuating according to signals that are received from said flame detector circuit and said tap opening detector switch corresponding to each said valve, and according to at least one signal received from said control circuit for monitoring flow of current through points of said control circuit.

2. The control circuit according to claim 1, wherein:

said microcontroller receives one signal to monitor flow of current through each said valve.

3. The control circuit according to claim 2, wherein:

said control circuit further comprises a common operating switch, common to all said valves, positioned in series with said operating switches of said valves, and a capacitor connected to ground between said common operating switch and said operating switches of each said valve.

4. The control circuit according to claim 3, wherein:

said microcontroller receives a signal for monitoring flow of current between said common operating switch and said operating switches of each valve.

5. The control circuit according to claim 1, wherein:

said tertiary control circuit is a monostable circuit.

6. The control circuit according to claim 1, wherein:

said tertiary control circuit is common to all of said valves.

7. The control circuit according to claim 1, wherein:

said flame detector circuit includes a thermocouple connected to an inverter amplifier that comprises an operational amplifier, a signal being supplied from said microcontroller to said input of said operational amplifier for checking functioning of said inverter amplifier, one terminal of said thermocouple being preferably connected to said chassis.

8. The control circuit for gas burners comprising:

a microcontroller that operates at least one valve that opens and closes gas flow to said burners, a flame detector circuit for each burner, said microcontroller receiving a signal from each of said flame detector circuits, and a tap opening detector switch associated with each burner, said microcontroller receiving a signal from each of said switches; wherein said control circuit comprises, for each valve two operating switches positioned in series, an operating voltage being supplied to said valve to open said valve when said operating switches are closed, two maintenance switches positioned in series, a maintenance voltage being supplied to said valve to keep said valve open when said maintenance switches are closed, and a fifth switch which short-circuits and de-energizes said valve when said fifth switch is closed, and one terminal of said valve being preferably connected to a chassis housing said burners, said operating switches, said maintenance switches and said fifth switch being controlled by said microcontroller, said microcontroller being connected to one of said operating switches, one of said maintenance switches and said fifth switch through circuits that close said one of said operating switches, said one of said maintenance switches, and said fifth switch are closed when pulses are not received from said microcontroller, and said microcontroller actuating according to said signals that are received from said flame detector circuit and said tap opening detector switch corresponding to said valve, and according at least one signal that is received from said control circuit to monitor flow of current through points of said control circuit.

9. The control circuit according to claim 8, wherein:

said microcontroller receives a signal to monitor flow of current through each said valve.

10. The control circuit according to claim 9, wherein:

said microcontroller receives a signal to monitor flow of current between said two operating switches of each said valve.

11. The control circuit according to claim 10, wherein:

said microcontroller receives a signal to monitor flow of current between said two maintenance switches of each said valve.

12. The control circuit according to claim 8, wherein:

one of said two operating switches and one of said maintenance switches are common to all said valves.

13. The control circuit according to claim 8, wherein:

said control circuit further comprises a capacitor connected to ground between said two operating switches.

14. The control circuit according to claim 8, wherein:

said circuits that close one of said operating switches of each valve, one of said maintenance switches of each valve, and said fifth switch are monostable circuits.

15. The control circuit according to claim 8, wherein:

said circuit that closes said fifth switch is common to all said valves.

16. The control circuit according to claim 8, wherein:

said flame detector circuit includes a thermocouple connected to an inverter amplifier with an operational amplifier, a signal being supplied from said microcontroller to said input of said operational amplifier for checking functioning of said inverter amplifier, one terminal of said thermocouple being preferably connected to said chassis.

* * * * *